US012004619B1

(12) United States Patent
Hincapie

(10) Patent No.: US 12,004,619 B1
(45) Date of Patent: Jun. 11, 2024

(54) SYSTEM TO ATTACH A LUGGAGE

(71) Applicant: Elkin Jose Hincapie, Miami, FL (US)

(72) Inventor: Elkin Jose Hincapie, Miami, FL (US)

( * ) Notice: Subject to any disclaimer, the term of this patent is extended or adjusted under 35 U.S.C. 154(b) by 0 days.

(21) Appl. No.: 18/237,966

(22) Filed: Aug. 25, 2023

(51) Int. Cl.

| | |
|---|---|
| ***B62B 5/06*** | (2006.01) |
| ***A45C 13/28*** | (2006.01) |
| ***A45C 13/30*** | (2006.01) |
| ***A45C 13/38*** | (2006.01) |
| ***A45F 5/02*** | (2006.01) |
| *A45F 3/00* | (2006.01) |

(52) U.S. Cl.
CPC ..... *A45C 13/30* (2013.01); *A45C 13/28* (2013.01); *A45C 13/38* (2013.01); *A45F 5/021* (2013.01); *A45F 2003/003* (2013.01)

(58) Field of Classification Search
CPC ..... B62B 5/068; A63B 2055/604; A45F 3/14
USPC ..... 224/184; 280/1.5
See application file for complete search history.

(56) References Cited

U.S. PATENT DOCUMENTS

| | | | | |
|---|---|---|---|---|
| 2,613,953 | A * | 10/1952 | Giovannoni | B62B 5/068 182/16 |
| 5,244,217 | A * | 9/1993 | Kotulla | B62B 5/068 280/1.5 |
| D367,142 | S * | 2/1996 | Platt | D34/27 |
| 10,716,380 | B2 * | 7/2020 | Haack | A45C 13/38 |
| 10,722,016 | B2 * | 7/2020 | Hughes | A45C 13/30 |
| 11,219,297 | B2 | 1/2022 | Haack | |
| 11,505,225 | B2 | 11/2022 | Ben Shoshan | |
| 2006/0021114 | A1 * | 2/2006 | Engel | B62B 5/068 2/312 |
| 2006/0138187 | A1 * | 6/2006 | Love | B60R 13/00 224/572 |
| 2009/0126150 | A1 * | 5/2009 | Tanaya | B62B 5/068 16/112.1 |
| 2012/0018932 | A1 * | 1/2012 | Fairbanks | A45F 3/14 267/69 |

* cited by examiner

*Primary Examiner* — Adam J Waggenspack
(74) *Attorney, Agent, or Firm* — Sanchelima & Associates, P.A.; Christian Sanchelima; Jesus Sanchelima

(57) ABSTRACT

A system to attach a luggage having a band assembly and an anchoring assembly. The system comprises an anchoring member and a connecting band. The anchoring member is designed to be securely tucked in, while the connecting band is specifically intended for attachment to the luggage. By utilizing this innovative system, users can securely fasten their luggage and enjoy a hands-free experience, allowing them to move freely without the need to constantly hold onto their belongings. This system offers a practical solution for those seeking convenience and mobility while traveling or on the go.

4 Claims, 4 Drawing Sheets

SYSTEM TO ATTACH A LUGGAGE

BACKGROUND OF THE INVENTION

1. Field of the Invention

The present invention relates to a system to attach a luggage and, more particularly, to a system to attach a luggage which is capable of being secured to a handle of a luggage to be pulled, by means of an anchoring member that is securely attached to the user or to the user's garment.

2. Description of the Related Art

Several designs for systems to attach a luggage have been designed in the past. None of them, however, incorporate a connecting band that can be attached to the luggage handle, with the connecting band further attached to an anchoring member securely fastened to the user or to user's garment. This configuration enables the user to pull the luggage while keeping the user's hand free.

Applicant believes that a related reference corresponds to U.S. Pat. No. 11,219,297 issued for method and apparatus for transporting a wheeled case. Applicant believes that another related reference corresponds to U.S. Pat. No. 11,505,225 issued for carrying device and system comprising the same. None of these references, however, teach of a system comprising a flexible band which is securely attached to the luggage, with the opposite end of the band attached to an anchoring member configured to be fastened to the user or to user's garment, keeping the user's hand free while pulling the luggage.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a device that allows users to pull their luggage while keeping their hands free.

It is one of the objects of the present invention to provide a device that eliminates the need of using metal components, preventing the device from being detected when crossing metal detectors.

It is another object of this invention to provide a device that is securely attached between the luggage and the user or to the user's garment, preventing the luggage from unintended detaching during movement.

It is still another object of the present invention to provide a device that increases comfort while pulling their luggage, eliminating the need to constantly hold onto the luggage handle.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
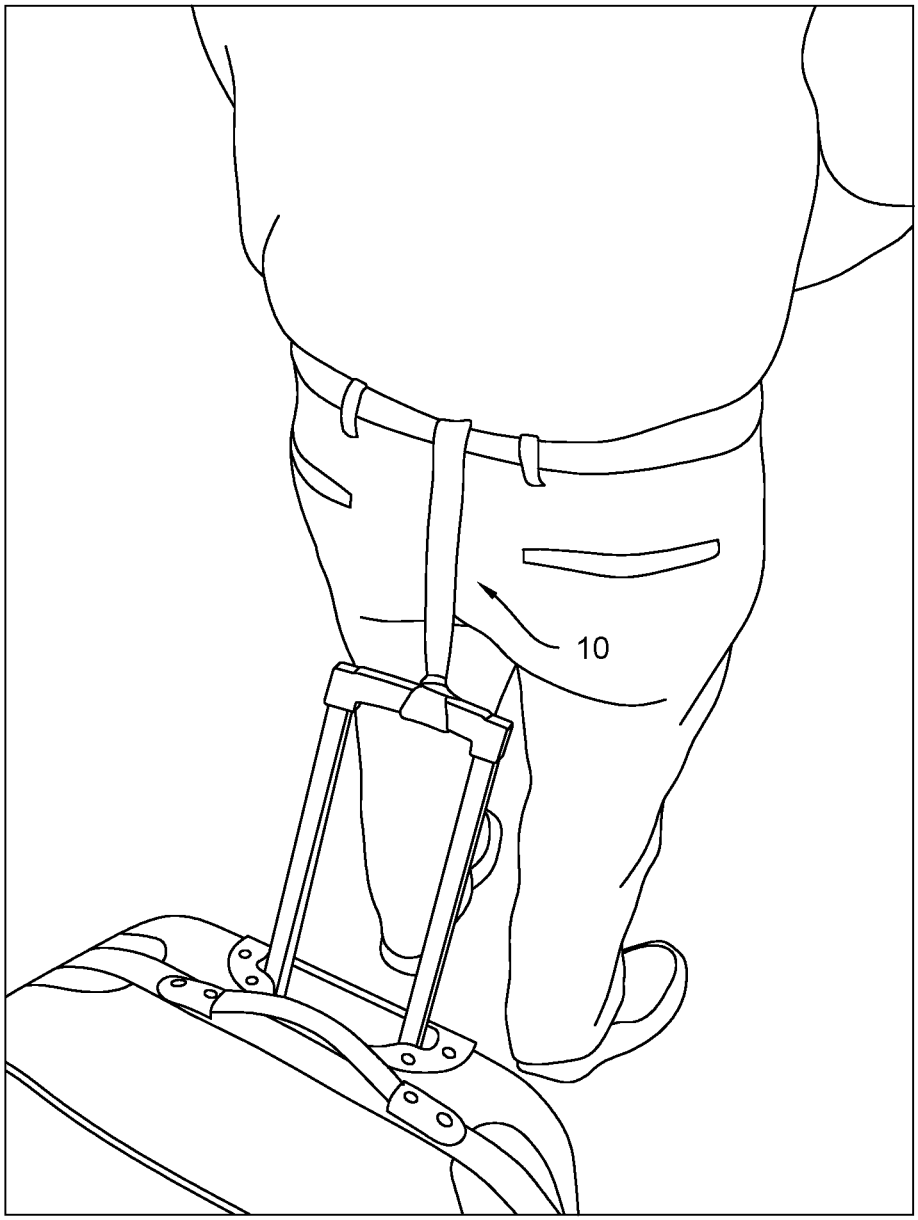
FIG. 1 represents an operational view of an exemplary embodiment of the present invention 10.

Referring now to the drawings, where the present invention is generally referred to with numeral 10, it can be observed that it basically includes a band assembly 20, and an anchoring assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
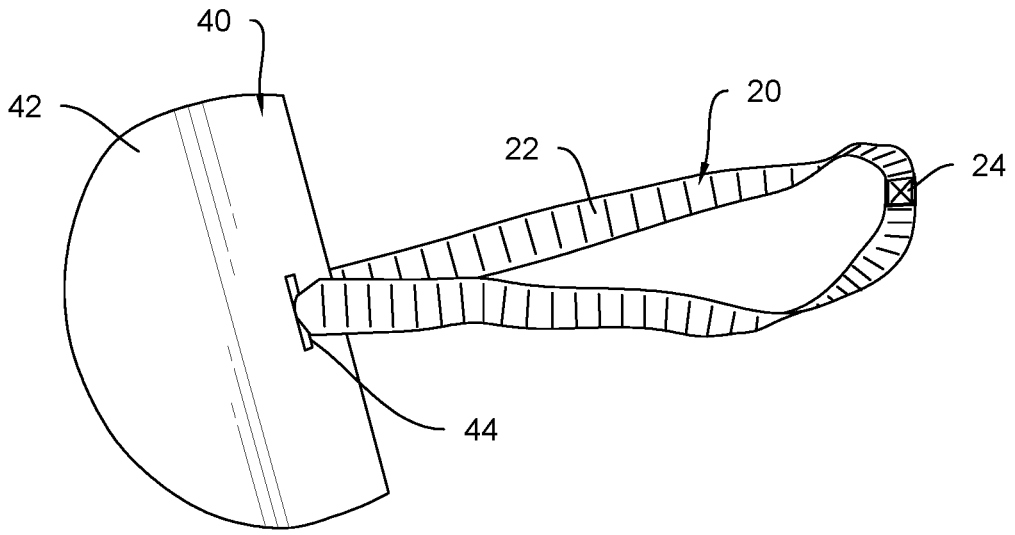
FIG. 2 shows an isometric view of the connecting band 22 being coupled to the anchoring member 42 through the opening band 44.

Band assembly 20 includes a connecting band 22 and an attaching member 24. In an exemplary embodiment, connecting band 22 may be a flexible strip made of a strong and durable material, such as leather, nylon, fabric, synthetic materials, or any other suitable material against wear and tear and tension. In a preferred embodiment, connecting band 22 may be rectangular with a predetermined length and a uniform width. The connecting band 22 is capable of forming a circle by attaching the ends thereof, thus defining the attaching member 24. It should be considered that attaching member 24 of the connecting band 22 is attached and stitched together, best depicted in FIG. 2. This configuration ensures that the connecting band 22 remains securely connected, preventing it from unraveling or coming apart. Nonetheless, it may be considered that attaching member 24 may include other fastening mechanisms such as hook and loop fasteners, allowing the user to attach and detach the ends of the connecting band 22.

Anchoring assembly 40 includes an anchoring member 42 and an opening 44. In an exemplary embodiment, anchoring device 42 may be a semicircular shaped member, best illustrated in FIG. 2. Anchoring member 42 includes the opening 44 in a portion thereof. In a suitable embodiment, the opening serves to receive the connecting band 22. It should be considered that the connecting band 22 passes through the opening 44 to provide an anchor member that is configured to be placed inside the user's garment, and more specifically inside the user's pants, as FIG. 1 represents. In a preferred embodiment, anchoring member 42 may be made of a suitable device that provides an anchoring connection between the user's garment and the connecting band 22, such as, nylon, rubber, leather. Nevertheless, it may be considered that anchoring member 42 may be made of a suitable material that provides comfort to the user when worn. Referring to FIG. 1, a portion of the connecting band 22 is capable of creating a knot on a luggage and more specifically to the luggage handle. Nonetheless, it should be considered that the connecting band 22 is capable of being connected to the luggage's handle by means of the attaching member 24 or any other suitable fastening mechanism. This configuration allows for a convenient and reliable attachment to pull the luggage while the user is walking. In a suitable variation, the anchoring member 42 may have an ergonomic shape to allow the user to walk freely.

Figure 3:
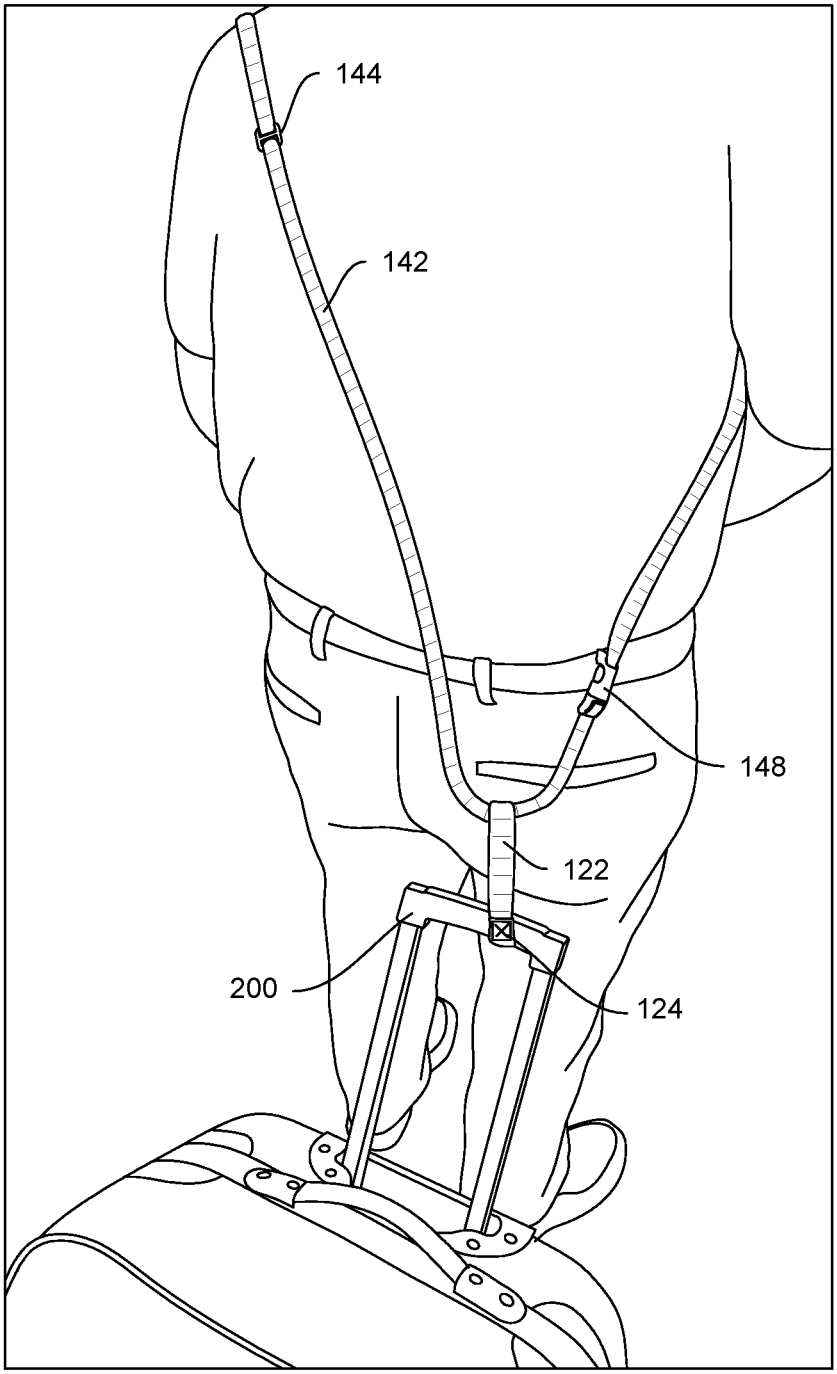
FIG. 3 illustrates an operational view of a suitable variation of the present invention 10 showing a belt strap 142 coupled to the connecting band 122.

In an alternative embodiment, as shown in FIG. 3, a portion of the strap 122 is securely attached to a portion of the belt strap 142, enabling another portion of the belt strap 142 to form a knot 124 when tied to the luggage handle 200. It should be considered that strap 122 may include a fastening mechanism to securely attach and detach the strap 122 from the belt strap 142. The strap 122, when detached from the belt strap 142, enables the user to form the knot 124 around the luggage handle to subsequently fasten the strap 122 to the belt strap 142, securing the luggage handle 200 to the strap 122 and further to the belt strap 142, as best depicted in FIG. 3. In a suitable embodiment, belt strap 142 is adapted to encircle and provide support from the user's shoulder to the user's lower back when extended or may encircle the user's waist when the length of the belt strap 142 is adjusted. The Belt strap 142 is equipped with a fastening mechanism, such as a side release buckle 148 which allows the user to securely fasten and release the belt strap 142 as needed. Belt strap 142 further includes an adjuster slider 144 to adjust the length of the belt strap 142 as needed by the user.

Figure 4:
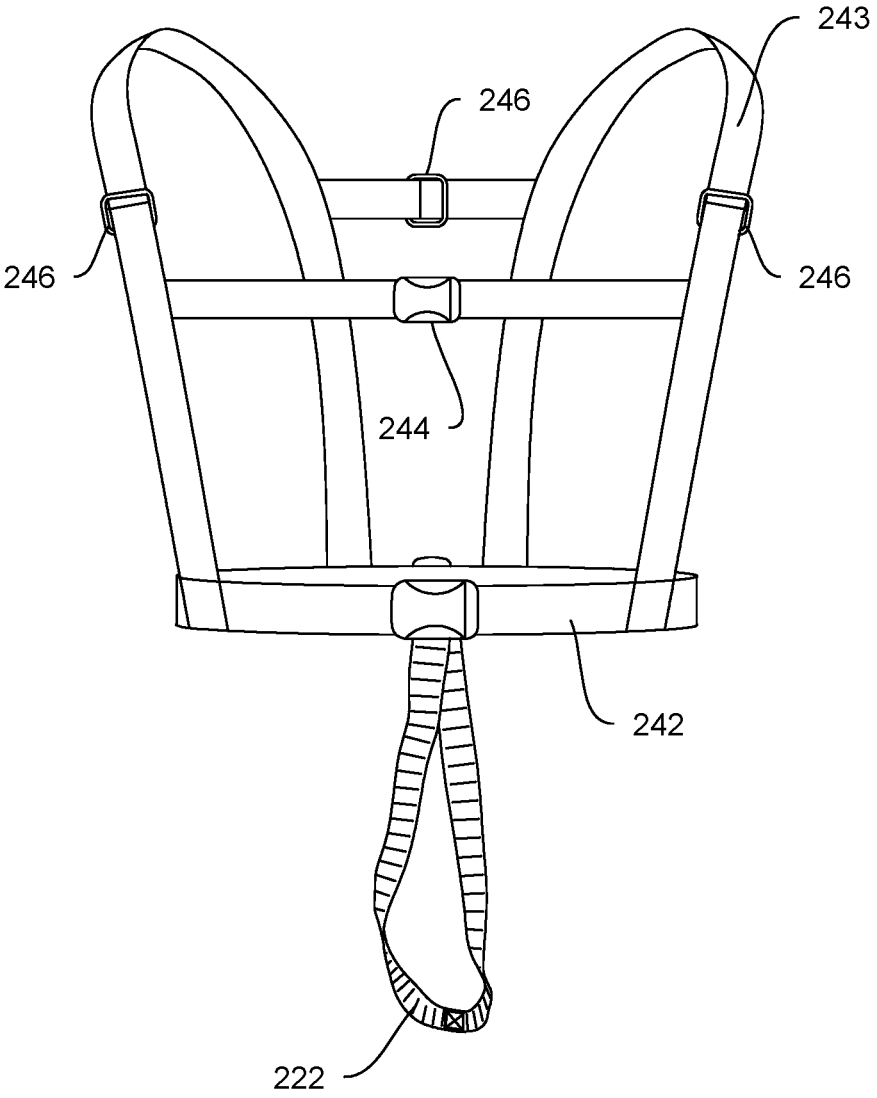
FIG. 4 is a representation of another suitable variation of the present invention 10, wherein the connecting band 222 is coupled to shoulder straps 243.

In another suitable alternative embodiment, connecting band 222 may be securely fastened to the belt strap 242. In a preferred embodiment, the belt strap 242 is configured to surround the user's waist. As best observed in FIG. 4, shoulder straps 243 are attached to a front portion and a back portion of the belt strap 242. The shoulder straps 243 are adapted to surround and provide support around the user's shoulders. It should be considered that the belt strap 242 and the shoulder straps 243 are securely fastened to the user's torso by means of a fastener mechanism, such as a side release buckle 244. In a suitable embodiment, the shoulder straps 243 are adjusted in length by means of a plurality of adjuster sliders 246 positioned in at least the shoulder straps 243 and the back strap which creates a connection between the shoulder straps 243, proving and adjustable system for the user's shoulders. In an exemplary embodiment, the connecting band 222 provides a connection between the luggage handle and the belt strap 242 allowing the user to pull the luggage, keeping the user's hands free.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system to attach a luggage, comprising:

a) a strap (122) having substantially a flexible body to form a knot (124) around a luggage handle (200), said strap (122) is capable of being attached to said luggage handle by means of said knot (124), said strap (122) is capable of being attached and detach from a belt strap (142), said strap (122) when detached from said belt strap (142) allows to create said knot (124) around said luggage handle (200) to subsequently fasten said strap (122) to said belt strap (142);

b) said belt strap (142) configured to be placed to a user by being wrapped over at least one shoulder of the user, said belt strap (142) having an opposite end configured to travel under the opposite user's arm, a portion of said belt strap (142) is connected to said strap (122), said belt strap (142) allows a luggage to be pulled by means of the connection between said knot (124) tied around said luggage handle and the connection of said strap (122) with said belt strap (142).

2. The system to attach a luggage of claim 1, wherein said belt strap (142) integrates a side release buckle (148) and an adjuster slider (144).

3. The system to attach a luggage of claim 2, wherein said release buckle (148) allows the user to attach and detach said belt strap (142) and said adjuster slider (144) allows said belt strap (142) to be adjusted in length.

4. A system to attach a luggage, consisting of:

a) a strap (122) having substantially a flexible body to form a knot (124) around a luggage handle, said strap (122) fixed to said luggage handle by means of said knot (124), wherein said strap (122) is capable of being attached and detach from a belt strap, said strap (122) when detached allows to create said knot (124) around said luggage handle (200), which said strap (122) is then attached to the belt strap (142), said strap (122) is capable of being attached and detach from a belt strap (142), said strap (122) when detached from said belt strap (142) allows to create said knot (124) around said luggage handle (200) to subsequently fasten said strap (122) to said belt strap (142);

b) said belt strap (142) configured to being placed to a user by being wrapped over at least one shoulder of the user, said belt strap (142) having an opposite end (142*a*) that travels under the user's arm, the at least one shoulder being opposite the user's arm that said belt strap travels under, a portion of said belt strap (142) is connected to said strap (122), said belt strap (142) allows a luggage to be pulled by means of the connection between said knot (124) tied in said luggage handle and the connection of said strap (122) with said belt strap (142), said belt strap (142) integrates a side release buckle (148) and an adjuster slider (144), said release buckle (148) allows the user to attach and detach said belt strap (142) and said adjuster slider allows said belt strap (142) to be adjusted in length.

* * * * *